United States Patent [19]

Juhl

[11] Patent Number: 4,717,149

[45] **Date of Patent: * Jan. 5, 1988**

[54] FREE THROW SHOOTING PRACTICE DEVICE

[76] Inventor: Mark J. Juhl, P.O. Box 185, Bendena, Kans. 66008

[ * ] Notice: The portion of the term of this patent subsequent to Nov. 18, 2003 has been disclaimed.

[21] Appl. No.: 899,591

[22] Filed: Aug. 25, 1986

Related U.S. Application Data

[63] Continuation of Ser. No. 853,186, Apr. 17, 1986, Pat. No. 4,623,148.

[51] Int. Cl.[4] ..... A63B 69/00; A63B 23/00

[52] U.S. Cl. ..... 273/1.5 A

[58] Field of Search ..... 273/1.5 A, 200 B, 189 R, 273/191 A, 54 D, 413; 272/67, 117, 134

[56] References Cited

U.S. PATENT DOCUMENTS

| | | | |
|---|---|---|---|
| 2,134,451 | 10/1938 | Mogren | 272/117 |
| 2,690,911 | 10/1954 | Newgren | 273/189 R |
| 2,756,056 | 7/1956 | Zega | 273/191 A |
| 2,773,691 | 12/1956 | Redfield | 273/189 R |
| 2,932,509 | 4/1960 | Zinkin | 272/117 |
| 3,037,299 | 6/1962 | Telford | 273/54 D |
| 3,550,937 | 12/1970 | Wright et al. | 273/1.5 A |
| 4,345,759 | 8/1982 | Nims | 273/1.5 A X |
| 4,357,010 | 11/1982 | Telle | 272/117 |
| 4,383,685 | 5/1983 | Bishop | 273/1.5 A |
| 4,561,661 | 12/1985 | Walker et al. | 273/413 X |

OTHER PUBLICATIONS

Mini-Gym, Inc. Brochure, date unknown, Chest Pass & Shooting Station 9XB.

*Primary Examiner*—Paul E. Shapiro

*Attorney, Agent, or Firm*—Schmidt, Johnson, Hovey & Williams

[57] ABSTRACT

A practice device for improving the shooting skills of basketball players is provided which effectively trains players in proper arm movement and follow-through for free throws and provides a realistic shooting "feel". The practice device advantageously includes a basketball rotationally coupled to an elongated support arm, the latter being pivotally mounted to an upright, adjustable frame. A shooting arm guide is also provided adjacent and generally below the basketball in the form of a pair of laterally spaced apart upright plates. In use, the shooter positions himself with his shooting arm within the guide and his hands in engagement with the ball in the normal shooting fashion. The ball is then pushed upwardly as in free throw shooting with the shooter's arm being maintained in a desirable upright orientation. The rotational mounting of the basketball also permits the shooter to practice the proper follow through as the ball leaves his hands.

6 Claims, 4 Drawing Figures

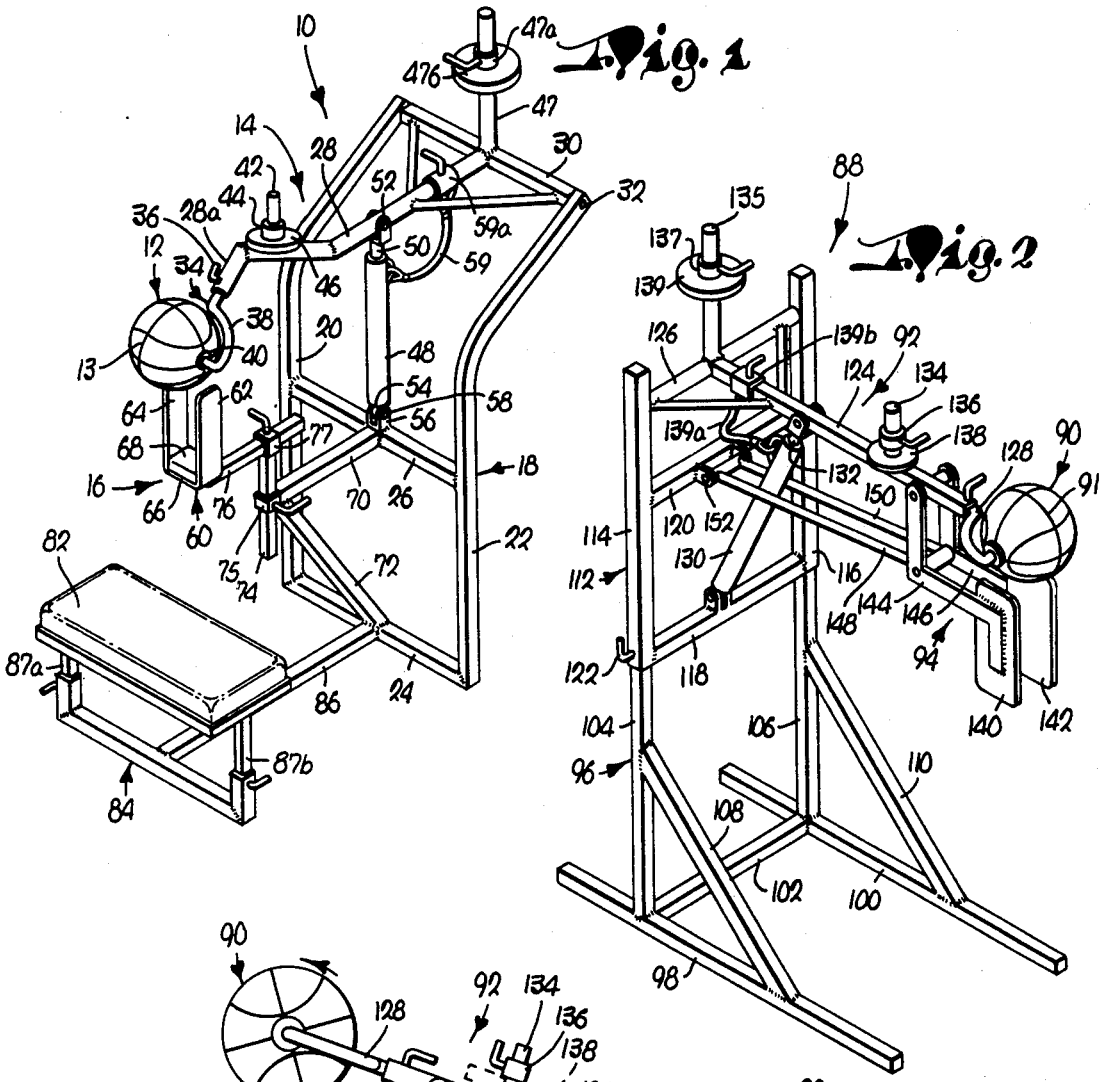
Fig. 1
Fig. 2
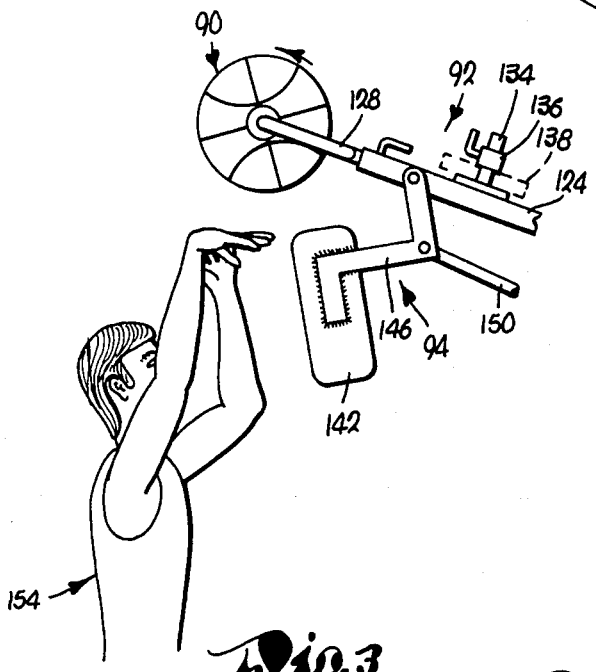
Fig. 3
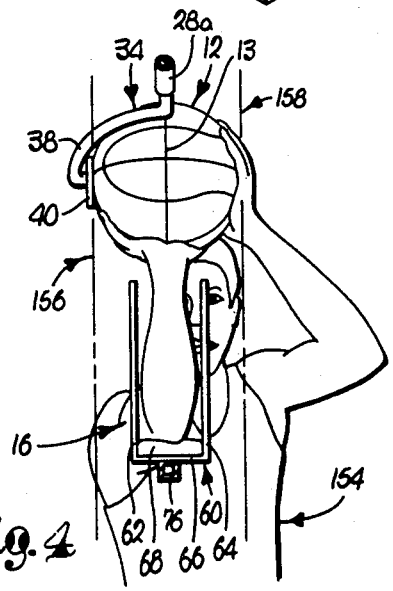
Fig. 4

FREE THROW SHOOTING PRACTICE DEVICE

This a continuation of application Ser No. 853,186 filed on Apr. 17, 1986, now U.S. Pat. No. 4,623,148.

BACKGROUND OF THE INVENTION

1. Field of the Invention

The present invention is concerned with a basketball shooting practice device designed to facilitate the training and execution of proper basketball shooting techniques. More particularly, it is concerned with such a practice device which permits a player to strengthen his shooting arm and hand while ensuring, through repetitive use of the device, that the player's overall shooting motion and follow through are optimized for maximum shooting efficiency. Although the device hereof is particularly useful for free throw shooting practice, all basketball shooting efforts are enhanced through practice using the device.

2. Description of the Prior Art

As every basketball coach and interested fan well knows, many basketball games are decided on the basis of success in free throw shooting. Indeed, it is estimated that about one-half of a team's wins and losses are decided on the basis of success or failure in shooting free throws. As a consequence, many coaches and players devote considerable time and effort to improving free throw shooting techniques.

Traditionally, players have practiced free throw shooting by simply standing at the free throw line of a basketball court, and taking a large number of practice shots. This approach presents a number of problems, however. First and foremost, such repetitive practice shooting can tend to perpetuate improper free throw shooting technique. For example, most coaches believe that it is important to keep the elbow of the shooting hand under the ball with the ball, shooting hand and elbow in the "shooting line", i.e., the area formed by two imaginary parallel lines running perpendicular to the court floor, one passing down the left side of the face of the shooter and the other passing down the outside of the shooting shoulder. If a player develops and improper elbow placement and movement, however, such an error can be reinforced by repetitive shooting.

In short, while basketball players certainly need to practice their free throw shooting, such needs to be done under conditions which stimulate and reinforce proper technique, rather than simply aggravate and make habitual improper methods. Hence, any practice device designed to aid the free throw shooter in developing the proper shooting touch and avoiding common shooting errors would represent a decided advantage. At the same time, such a device should also facilitate proper techniques for other types of basketball shots.

SUMMARY OF THE INVENTION

The present invention provides a basketball free throw shooting practice device of unique construction which can rapidly and effectively be used by basketball players to sharpen their free throw shooting skills. Broadly speaking, the practice device of the invention includes a basketball, along with means for supporting the basketball in an elevated position. This support means advantageously includes an elongated arm, with means operatively coupling the basketball to the arm adjacent one end thereof, with additional means supporting the other end of the arm for pivotal movement thereof about a generally horizontal axis. A shooting arm guide is also provided adjacent the basketball and includes a pair of upright, laterally spaced apart guide members oriented for receiving a shooter's arm therebetween.

In particularly preferred forms of the invention, an upright frame structure is provided which includes means for adjusting the height of the basketball and arm; the arm further includes means for selective attachment of weight thereto so as to permit variance of the resistance to movement presented by the arm.

In order to develop the most accurate "feel" in the device, the basketball should be rotationally coupled to the supporting arm, so that during practice with the device proper follow through and backspin on the ball can be developed.

In one form of the invention, a sit-down device is employed which allows the shooter to sit and fully concentrate upon arm movements. In this form, the shooting arm guide comprises a U-shaped member, with an elbow pad at the bight of the member. In another embodiment, a stand-up practice aid is provided which includes a shooting arm guide in the form of a pair of laterally spaced apart plates. These are in turn pivotally coupled to the ball-supporting arm with linkage means being provided for pivoting the guide plates away from the basketball player as the ball is moved upwardly during simulated shooting.

In the use of devices in accordance with the invention, the player properly positions himself with respect to the basketball by placing his shooting arm in the guide and with his hands grasping the ball in the normal shooting position. At this point the player simulates the shooting motion by raising his shooting arm vertically and forwardly in order to "push" the ball through a pivotal arc. Such is permitted by virtue of the pivotal mounting of the ball-supporting arm so as to effectively simulate actual free throw shooting. If desired, one or more weights can be placed on the ball-supporting arm to increase the resistance to movement presented by the assembly. This in turn can be used to increase the strength of the shooter's arm and wrist.

The guide structure provided with the practice aid of the invention ensures that the shooter's elbow is properly positioned beneath the ball, and that the shooting movement is properly confined to the desirable shooting line.

BRIEF DESCRIPTION OF THE DRAWING

FIG. 1 is a perspective view of one embodiment in accordance with the present invention;

FIG. 2 is a perspective view of a second embodiment of a practice device in accordance with the invention;

FIG. 3 is a fragmentary side view illustrating use of the FIG. 2 practice device; and FIG. 4 is a sectional view depicting use of the sit-down practice device illustrated in FIG. 1.

DESCRIPTION OF THE PREFERRED EMBODIMENTS

Turning now to the drawing, FIGS. 1 and 4 illustrate a practice device 10 in accordance with the invention. Broadly speaking, the device 10 includes a modified regulation basketball 12 which is advantageously filled with a yieldable synthetic resin foam and has an orienting center line 13 on the exterior threof, along with means broadly referred to by the numeral 14 for supporting the basketball in an elevated position. The device 10 further includes shooting arm guide means 16 situated adjacent basketball 12 for supporting and confining a player's shooting arm.

In more detail, the ball-supporting means 12 includes an upright frame assembly 18 including a pair of upright rails 20, 22 which are laterally spaced apart as illustrated, but interconnected by means of a pair of cross members 24, 26. The upper ends of the rails 20, 22 are bent outwardly as illustrated, to present an uppermost end spaced outwardly from the underlying cross members 24, 26.

The ball support means 14 further includes an elongated arm 28 which is fixedly secured to a transversely extending cross member 30. The latter is in turn pivotally coupled as at 32 to the upper ends of the rails 20, 22; as a consequence, it will be appreciated that the arm 28 is pivotal about a generally horizontal axis.

As illustrated, the arm 28 is tubular and presents an upwardly and downwardly extending dogleg section **28*a* adjacent ball 12. The end of arm 28 remote from cross member 30 is designed to receive an arm extension 34. The latter is adjustably maintained in position by means of L-shaped set screw 36. In this fashion, the effective length of the arm 28 can be adjusted, as will be readily appreciated by those skilled in the art; moreover, this permits extension 34 to be rotated axially to accommodate both left and right-handed shooters as more fully explained hereinafter. Further, the orientation of dogleg section 28*a* assures that the extension 34** is oriented at about a 45 degree angle downwardly as shown, to assure that the ball-supporting arrangement does not interfere with the shooter's arm or hand movement and follow through.

The outer end of extension 34 is in the form of a hook-like portion 38 which is affixed to ball 12 as depicted. That is to say, the outermost end of portion 38 is in the form of a rectilinear shank oriented along a central axis of the ball 12, and conventional connection structure including washer 40 is employed to rotationally couple the ball to the shank end or portion 38.

The arm 28 is further provided with an upstanding shaft 42 situated along the upwardly extending portion of dogleg **28*a*, and a lockable collar 44 is situated on the shaft 42. In this fashion, annular weights 46 can be placed over the shaft 42, and locked in place by means of collar 44. This allows selective variation in the effective length of the arm and hence the resistance to movement presented thereby. A counterbalance weight assembly is also secured to arm 30 and includes a similar upstanding shaft 47 provided with a lockable set clamp 47*a* and a weight-supporting stop (not shown) beneath the clamp. This permits attachment of a weight 476 to the shaft 47** as shown.

The ball-supporting means 14 further includes means for slowing and cushioning gravity-induced pivoting of the arm from an elevated position to the rest position depicted in FIG. 1. This cushioning apparatus is advantageously in the form of an elongated dashpot cylinder 48 having an extensible rod 50 provided with an outermost clevis 52. The clevis 52 is in turn pinned to the arm 28 as illustrated. The lowermost end of the cylinder 48 is provided with a tang 54, the latter being received by an upstanding clevis 56 affixed to cross member 26. A pin 58 is employed to pivotally secure the tang 54 to clevis 56.

Finally, it will be seen that the device is provided with a stretchable "bungle cord" 59 operatively connected between the top of cylinder 48 and the end of arm 28 adjacent cross member 30, the latter connection being adjustable by means of shiftable wet clamp **59*a*. The cord 59 serves as a return assist device for the arm 28**.

The guide means 16 includes an upstanding, generally U-shaped in cross section element 60 presenting a pair of laterally spaced apart side plates 62, 64, and an interconnecting bight 66. An elbow pad 68 is located within the confines of the element 60 adjacent the bight thereof (see FIG. 4).

The U-shaped element 60 is supported in a manner permitting both vertical and horizontal adjustment thereof. To this end, an elongated, tubular leg 70 is secured to cross member 26 and extends rearwardly therefrom. A diagonally extending brace 72 is secured to the underside of leg 70 and to cross member 24 to provide additional support. An upright extension 74 is adjustably supported at the rearward end of leg 70 by means of set clamp 75. A forwardly extending tubular connection segment 76 is affixed to the underside of bight 66, and is adjustably received by a set clamp 77 carried at the upper end of extension 74.

The overall device 10 further includes a seat 82 located generally below the guide element 60. This seat is in turn supported by adjustable frame structure 84 including a forwardly extending connector 86 permanently affixed to cross member 24, and vertically adjustable legs **87*a*, 87*b***.

In the second embodiment of the invention illustrated in FIGS. 2 and 4, a practice device 88 of the stand-up variety is provided. The device 88 again includes a foam-filled basketball 90, having a centerline 91, ball-support means 92, and shooting arm guide means 94.

The ball-support means 92 includes a rigid lower frame assembly 96 having a pair of elongated, laterally spaced apart, floor-engaging rails 98, 100, interconnected by cross member 102. An upstanding frame section 104, 106 is respectively secured to each of the floor-engaging rails 98, 100, and corresponding, diagonally extending bracing rails 108, 110, are provided for supporting and rigidifying the upright frame sections 104, 106.

The overall ball support means further includes an upper, vertically shiftable frame 112 including a pair of hollow tubular side rails 114, 116, interconnected by vertically spaced apart cross members 118 and 120. As illustrated in FIG. 2, the side rails 114, 116, telescopically receive corresponding frame sections 104, 106, and appropriate set screw clamp means 122 is provided for locking the upper frame 112 to the lower stationary frame at selected vertical positions.

A ball-supporting arm 124 also forms a part of the overall support means 92, and is in the form of an elongated, tubular member as depicted. One end of the arm 124 is rigidly secured to a cross member 126, and the latter is in turn pivotally coupled to the respective side rails 114, 116. The end of arm 124 remote from cross member 126 receives an arm extension 128 which is identical with the extension 34 described with reference to the embodiment of FIGS. 1 and 4. Further, the ball 90 is rotationally coupled to the outer end of the extension 128, in exactly the same manner as in the first-described embodiment. Cushioning means is provided for the arm 124 in the form of a dashpot cylinder 130. This cylinder is pivotally coupled to cross member 118, and has an extensible rod 132 pivotally secured to the arm 124 as shown. As in the case of the first embodiment, arm 24 and cross member 126 include respective upright weight-supporting shafts 134, 135 provided with an adjustable locking clamp 136, 137 for permitting ready attachment of annular weights 138, 139. A bungle cord 139*a* is secured to cylinder 132, and is adjustably attached to the forward end of arm 124 by means of clamp 139*b*.

The guide menas 94 in this embodiment is in the form of a pair of laterally spaced apart, upright plates 140, 142. The plates 140, 142 are supported generally beneath ball 90 by means of a pair of somewhat Z-shaped brackets 144, 146. These brackets are pivotally secured by conventional means to arm 124 as depicted. Moreover, a pair of elongated links 148, 150 are pivotally coupled to the corresponding brackets 144, 146, at points between the associated plates and arm 124 (see FIG. 3). The remote ends of these links are in turn pivotally attached to cross member 120 by means of a conventional pivotal connector 152.

Attention is next directed to FIG. 3 which illustrates a player 154 using the stand-up device illustrated in FIG. 2. In such use, the player first places his shooting arm between the plates 140, 142, with the arm of the shooting hand being generally beneath the ball. The index finger of the shooting hand is then aligned with line 91 on ball 90. The player's other hand is then placed generally on the side of the ball as is conventional in basketball shooting. Both left and right handed shooters can be accommodated with the practice device, it being necessary only to rotate extension 128 180° as necessary to orient the free side of ball 90 for either a left or right handed shooter.

In any event, the player next moves his shooting arm upwardly and forwardly as in conventional free throw shooting, so as to move ball 90 and hence arm 124 related structure through a pivotal arc. As the shooter's arm becomes fully extended, his wrist may be "flipped" in the normal manner to impart a backspin to the ball 90, such being permitted inasmuch as the ball 90 is rotationally coupled to the extension 128.

It will further be observed that as the simulated shooting is carried out, the guide plates 140, 142 are pivoted outwardly and away from the player 154. This occurs by virtue of the action of the links 148, 150 as will be readily appreciated from a study of FIGS., 2 and 3. However, the presence of the plates 140, 142 ensures that the shooter's arm movement will be essentially vertical and remain in the desirable shooting line.

After the ball 90 leaves the shooter's hands, it typically travels some distance depending upon the shooter's strength and the attachment point and yieldability of cord 139*a*. At some point, however, such upward pivoting movement ceases, and the ball, together with the associated shiftable supporting structure, moves back to the rest position of the device through the influence of gravity. In order to prevent too rapid downward movement and to avoid mechanical shocks to the assembly, the dashpot cylinder 130 comes into play in order to cushion and slow such gravity-induced return movement.

Use of the embodiment of FIGS. 1 and 4 is similar in many respects to that described with reference to the stand-up embodiment of FIGS. 2 and 3. However, in the sit-down version of the device, the player sits on seat 82 and places his shooting arm within the confines of U-shaped element 60. As best seen in FIG. 4, the player rests the elbow of his shooting arm on the pad 68, with the arm extending vertically upwardly to engage the underside of the ball 12. As shown, the other hand of the player engages the free side of ball 90 for guiding purposes. The player then simulates shooting by moving his arm upwardly and forwardly to induce an upward pivotal movement in the ball 12 and its supporting structure. As seen in FIG. 4, the proper shooting line defined by the reference lines 154, 156 is necessarily maintained by the player during use of the device 10. Finally, after the ball 12 reaches the limit of its upward arc, gravity induced return movement thereof is cushioned and slowed by means of dashpot cylinder 48.

It will thus be appreciated that the present invention provides a greatly improved practice device permitting basketball players to readily enhance their shooting skills, while avoiding the bad shooting habits frequently developed during simple unrestricted practice shooting. At the same time, the device strengthens the shooter's wrist and arm.

I claim:

1. A basketball shooting practice device, comprising:

a basketball;

means for supporting said basketball in an elevated position, and for mounting the ball for translational movement of the ball upwardly and away from an initial rest position;

arm-engaging means oriented for receiving the elbow region of a shooter's arm in the initial shooting position of the shooter's arm; and means mounting said arm-engaging means for maintaining the arm-engaging means stationary during upward shooting movement of the shooter's arm during use of the device, with the shooter's arm being freed from contact with said arm-engaging means during said upward shooting movement of the shooter's arm.

2. The practice device of claim 1, said arm-supporting means including a pair of upright, laterally spaced apart guide members.

3. The practice device of claim 1, said basketball-supporting means including upright frame structure and an elongated arm having one end thereof pivotally secured to the frame structure for pivoting of the arm about a generally horizontal axis, the other end of said arm operatively coupled with said ball-supporting structure.

4. The practice device of claim 3, including means for selective attachment of a weight to said arm for selective variance of the resistance movement presented by the arm.

5. The practice device of claim 3, including apparatus operatively coupled to said arm for slowing and cushioning gravity-induced pivoting of the arm.

6. The practice device of claim 1, said arm-engaging means including an elbow pad.

* * * * *